US006292084B1

(12) United States Patent
Choi et al.

(10) Patent No.: US 6,292,084 B1
(45) **Date of Patent: *Sep. 18, 2001**

(54) FINE INDUCTOR HAVING 3-DIMENSIONAL COIL STRUCTURE AND METHOD FOR PRODUCING THE SAME

(75) Inventors: Chang Auck Choi; Jong Hyun Lee; Won Ick Jang; Yong Il Lee; Jong Tae Baek; Hyung Joun Yoo, all of Daejeon (KR)

(73) Assignee: Electronics and Telecommunication Research Institute, Daejeon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/136,613

(22) Filed: Aug. 20, 1998

(30) Foreign Application Priority Data

Sep. 10, 1997 (KR) ..... 97-46644

(51) Int. Cl.[7] ..... H01F 5/00
(52) U.S. Cl. ..... 336/200; 336/225
(58) Field of Search ..... 336/223, 200, 336/225, 232, 83; 29/602.1, 603.23, 603.24, 603.25

(56) References Cited

U.S. PATENT DOCUMENTS 3,614,554 * 10/1971 Richardson et al. ..... 336/200
3,638,156 * 1/1972 West ..... 336/223
3,881,244 * 5/1975 Kendall ..... 336/223
4,729,510 * 3/1988 Landis ..... 336/200
5,095,357 3/1992 Andoh et al. .
5,372,967 * 12/1994 Sundaram et al. ..... 336/200
5,384,274 1/1995 Kanehachi .
5,610,433 3/1997 Merrill et al. .

OTHER PUBLICATIONS

Chong H. Ahn and Mark G. Allen; A Fully Integrated Surface Micromachined Magnetic Microactuator with a Multilevel Meander Magnetic Core; 1993; pp. 15–22. (No month).

* cited by examiner

*Primary Examiner*—Lincoln Donovan
*Assistant Examiner*—Tuyen T. Nguyen
(74) *Attorney, Agent, or Firm*—Antonelli, Terry, Stout & Kraus, LLP

(57) ABSTRACT

A fine inductor having a 3-dimensional coil structure is disclosed. The inductor includes an insulating layer having a groove, a plurality of first conductive patterns wherein the respective first conductive patterns cover bottom and both walls of the groove formed in the insulating layer, both ends of the respective first conductive patterns are extended over upper surface of both sides of the groove, and each of the first conductive patterns is disposed at a predetermined space between adjacent first conductive patterns, and a plurality of second conductive patterns wherein one ends of the respective second conductive patterns are connected to the one ends of the first conductive patterns extended over upper surface and the other ends of the respective second conductive patterns are connected to the other ends of the adjacent first conductive patterns extended over upper surface, thereby forming a coil structure together with the first conductive patterns.

5 Claims, 5 Drawing Sheets

FINE INDUCTOR HAVING 3-DIMENSIONAL COIL STRUCTURE AND METHOD FOR PRODUCING THE SAME

BACKGROUND OF THE INVENTION

1. Field of the Invention

The present invention relates generally to a fine inductor and more particularly to a fine inductor having a 3-dimensional coil structure on a surface of a semiconductor, wherein the inside of the coil is hollow, and also relates to a method for producing such a fine inductor.

2. Description of Related Art

Generally, a fine inductors having a micrometer size is used for a low and high frequency transmitter and receiver as passive components which are necessary for realizing a transmitting and receiving circuit for a specified electromagnetic wave in a radio communication integrated circuit.

When the inductor is integrated on the integrated circuit, however, since processing of 3-dimensional coil structure is difficult, a spiral structure having a coil structure which is partially planar is mainly used. The inductor having the plane coil structure has large design areas, has large parasitic capacitances which are generated from bottom portions of metal wirings structurally, and requires spaces between the metal wirings and inductor to avoid electrostatic induction in portions over which the metal wirings are crossed.

Further, method is proposed for realizing vertical coil shape by piling metal layers and insulating layers on the substrate in a multi-layer structure, but its manufacturing method is complex and because the insulating layers are filled between the coils, it has large parasitic capacitances and large contact resistances in wiring, thereby providing large resistance of inductor itself.

SUMMARY OF THE INVENTION

An object of the present invention is to provide a fine inductor having a 3-dimensional coil structure for reducing occupied areas in comparison with a planar spiral inductor and reducing parasitic capacitances by rendering an interior of the coil hollow, and a method for producing such a fine inductor.

To achieve the above object, the present invention provides a fine inductor having a 3-dimensional coil structure including an insulating layer having a groove, a plurality of first conductive patterns wherein the respective first conductive patterns cover the bottom and both walls of the groove formed in the insulating layer, both ends of the respective first conductive patterns are extended over an upper surface of both sides of the groove, and each of the first conductive patterns is disposed at a predetermined space between adjacent first conductive patterns, and a plurality of second conductive patterns wherein one end of the respective second conductive patterns are connected to the one end of the first conductive patterns extended an over upper surface and the other ends of the respective second conductive patterns are connected to the other ends of the adjacent first conductive patterns extended an over upper surface, thereby forming a coil structure together with the first conductive patterns.

According to another aspect of the invention, a method for producing a fine inductor having a 3-dimensional coil structure includes the steps of forming an insulating layer on a substrate and forming a groove in a predetermined region for the inductor to be formed, forming a plurality of first conductive patterns wherein each of the first conductive patterns covers a bottom and both walls of the groove formed in the insulating layer, both ends of the respective first conductive patterns are extended over upper surface of both sides of the groove, and each of the first conductive patterns is disposed at a predetermined space between adjacent first conductive patterns, being filled with material having etching properties different from those of the first conductive patterns in the groove, forming a second conductive layer having etching properties different from those filled in the groove, selectively etching the second conductive layer to form a plurality of second conductive patterns wherein one end of the respective second conductive patterns are connected to the one ends of the first conductive patterns extended over upper surface and the other end of the respective second conductive patterns are connected to the other ends of the adjacent first conductive patterns extended over an upper surface, thereby forming a coil structure together with the first conductive patterns, and removing the material formed in the groove.

BRIEF DESCRIPTION OF THE DRAWINGS

Other features and objects of the present invention will be apparent from the following description in connection with the accompanying drawings.

DETAILED DESCRIPTION OF THE PREFERRED EMBODIMENTS

A fine inductor according a preferred embodiment of the present invention will now be described in detail with reference to the attached drawings.

Figure 1:
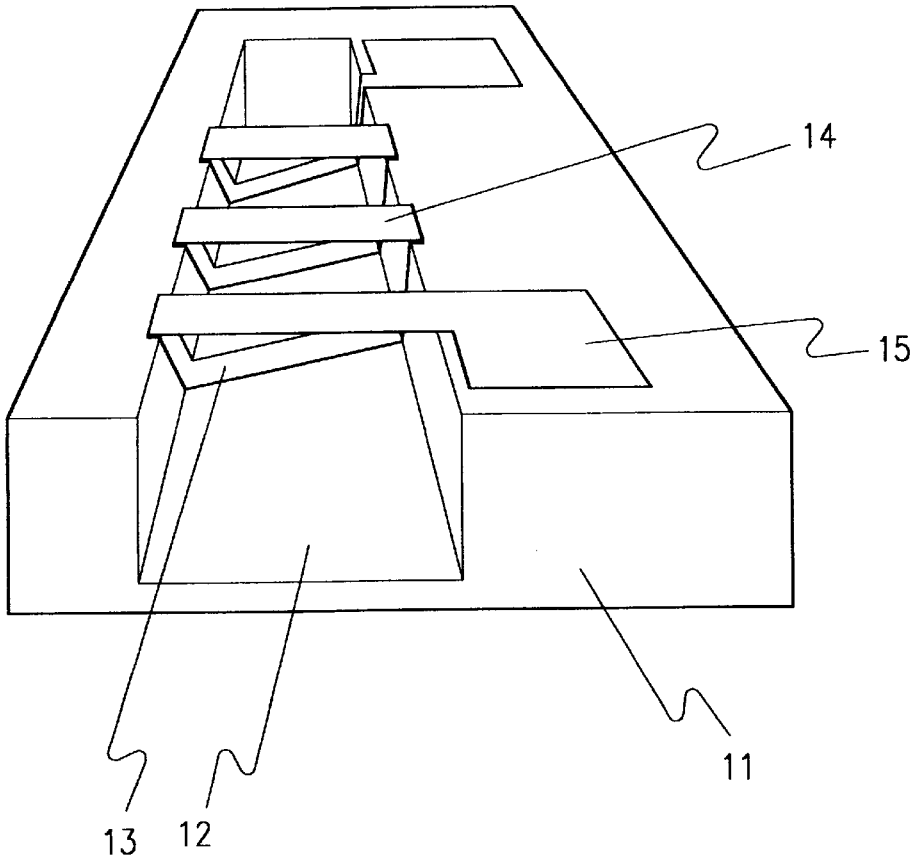
FIG. 1 is a perspective view showing a fine inductor having a 3-dimensional coil structure according to a preferred embodiment of the present invention.
Figure 2A:
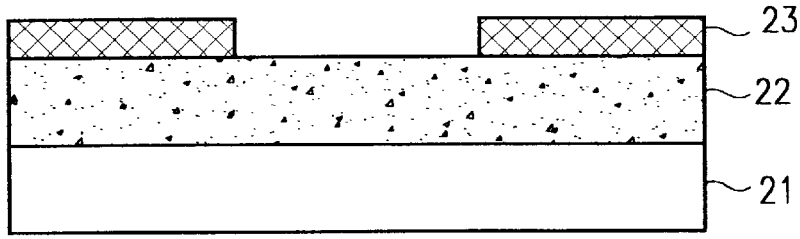
FIGS. 2(*a*) to 2(*g*) are sectional views showing respective steps of the method of producing a fine inductor having a 3-dimensional coil structure according to a preferred embodiment of the present invention.
Figure 2B:
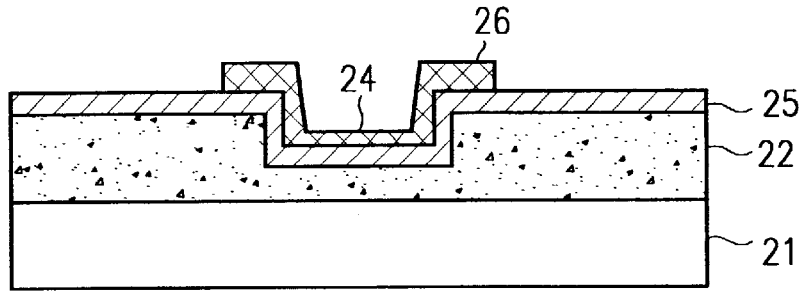
Figure 2C:
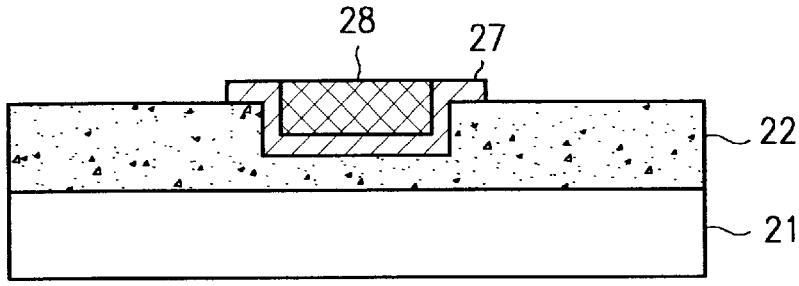
Figure 2D:
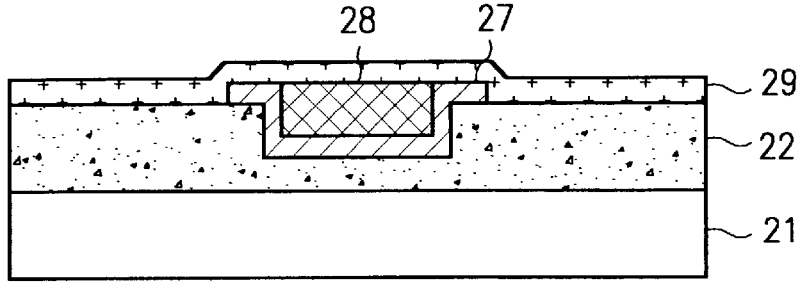
Figure 2E:
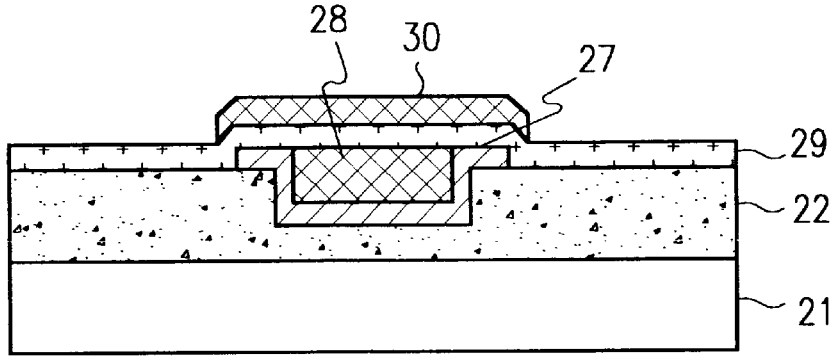
Figure 2F:
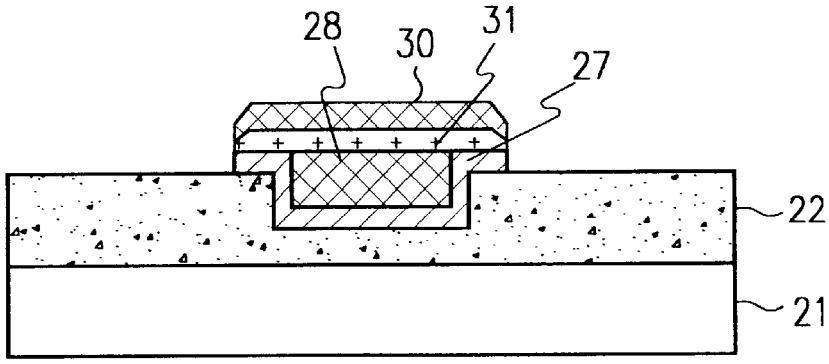
Figure 2G:
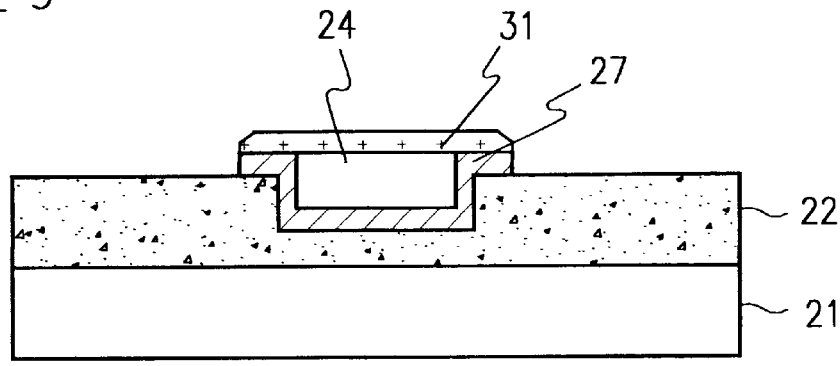
Figure 3A:
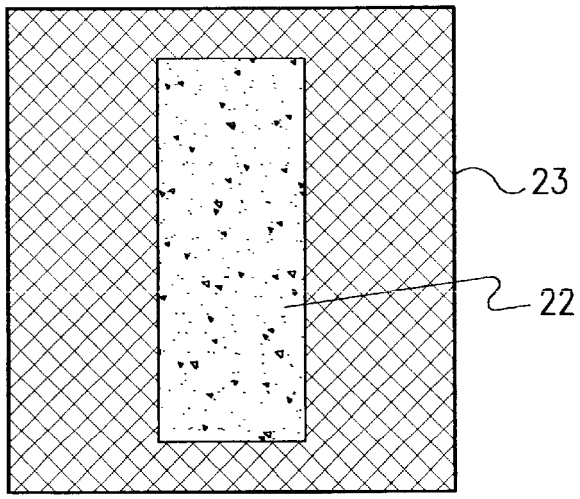
FIGS. 3(*a*) to 3(*e*) are planar views showing respective steps of the method of producing a fine inductor having a 3-dimensional coil structure according to a preferred embodiment of the present invention.
Figure 3B:
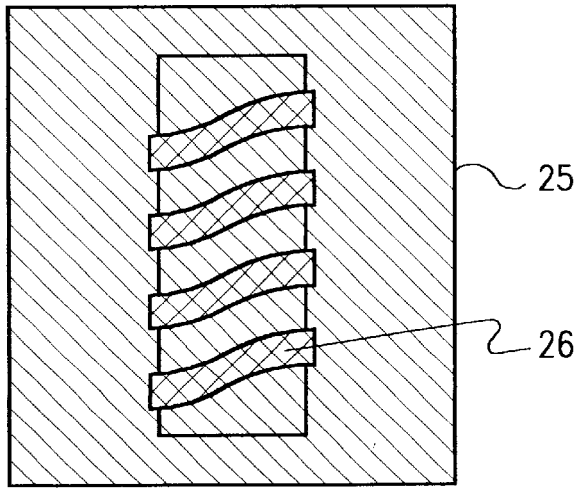
Figure 3C:
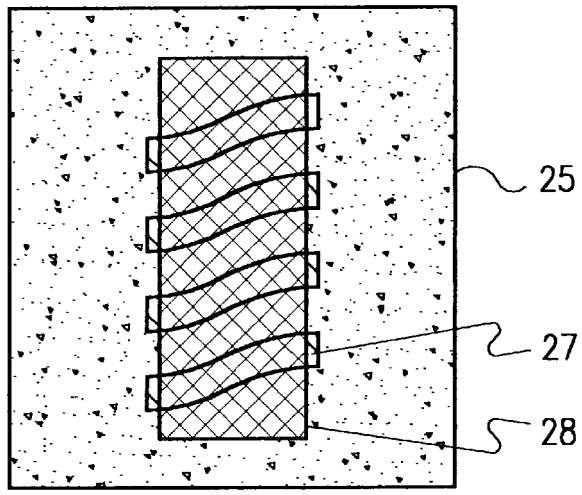
Figure 3D:
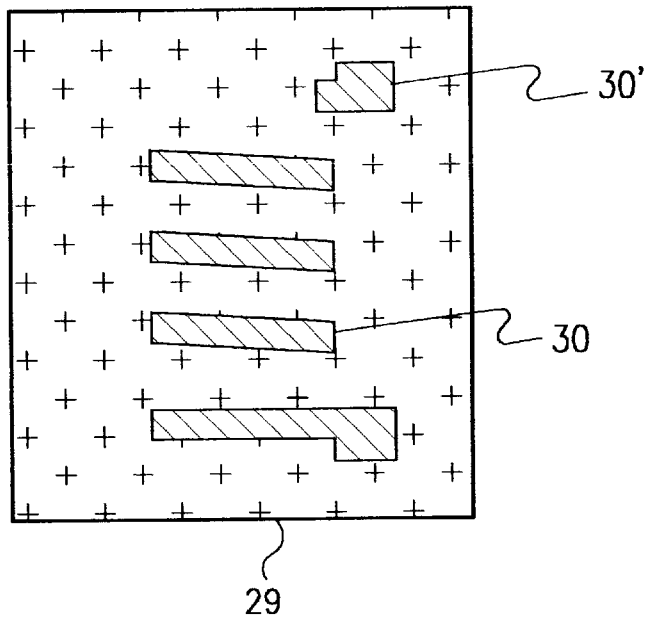
Figure 3E:
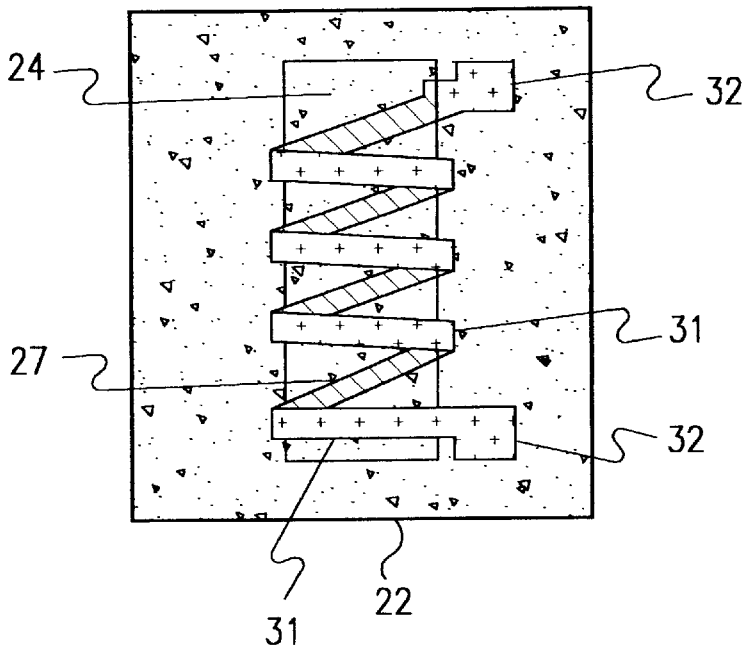

Referring to FIG. 1, the fine inductor includes a plurality of first metal patterns 13 wherein each of the first metal patterns covers a bottom and both walls of groove 12 formed in an insulating layer 11, both ends of the respective first metal patterns are extended over an upper surface of both sides of the groove 12, and each of the first metal patterns is disposed at a predetermined space between adjacent first metal patterns, a plurality of second metal patterns 14 wherein one end of the respective second metal patterns are connected to the one end of the first metal patterns 13 extended over an upper surface and the other end of the respective second metal patterns are connected to the other end of the adjacent first metal patterns 13 extended over upper surface, thereby forming a coil structure together with the first metal patterns 13, and a pair of connecting pads 15 which are connected to both ends of the coil.

In the inductor having the structure wherein the inside of the coil is hollow, when current flows through the metal line comprised of the first and second metal patterns 13 and 14, it proceeds along rotational direction of the wound coil to generate magnetic flux inside of the coil, thereby functioning as inductor.

Referring to FIGS. 2(*a*) to 2(*g*) and FIGS. 3(*a*) to 3(*e*), the process of producing a fine inductor having a 3-dimensional coil structure as mentioned above will be explained.

As shown in FIGS. 2(*a*) and 3(*a*), a photoresist pattern 23 for exposing a portion of an oxide layer 22 in which the inductor will be formed, is formed to have a groove structure in the oxide layer 22 which is formed on a semiconductor substrate 21.

Next, as shown in FIGS. 2(*b*) and 3(*b*), the oxide layer 22 is etched using the photoresist pattern 23 as etching mask to form a groove 24 and after removing the photoresist pattern 23, a first metal layer 25 made of, for example, aluminium is deposited on the entire surface. Further, a plurality of photoresist patterns 26 are formed which covers a plurality of portions on a bottom and both walls of groove 24 formed in the oxide layer 22, both ends of the respective photoresist patterns are extended over a surface of the first metal layer 25 on both sides of the groove 24, and each of the photoresist patterns 26 is disposed at a predetermined space between adjacent photoresist patterns.

Next, as shown in FIGS. 2(*c*) and 3(*c*), the first metal layer 25 is etched by a plasma etching method or wet etching method using the photoresist patterns 26 as an etching mask to form a plurality of first metal patterns 27. Subsequently, after removing the photoresist patterns 26, a photoresist 28 having etching property which is different from that of the first metal patterns 27 is filled in the groove 24 to bake the photoresist 28. In this case, a doped spin on glass may be used instead of the above filled photoresist.

Next, as shown in FIG. 2(*d*), there is deposited a second metal layer 29 on the entire resultant structure.

Subsequently, as shown in FIGS. 2(*e*) and 3(*d*), there are formed a plurality of photoresist patterns 30 on the second metal layer 29 to define a plurality of second metal patterns wherein one end of the respective photoresist patterns 30 are connected to one end of the first metal patterns 27 extended over an upper surface and the other ends of the respective photoresist patterns 30 are connected to the other ends of the adjacent first metal patterns 27 extended over an upper surface, thereby forming a coil structure together with the first metal patterns 27. In this case, the photoresist patterns 30 includes two photoresist patterns 30' to define a pair of connecting pads which are connected to both ends of the coil.

Next, as shown in FIG. 2(*f*), the second metal layer 29 is etched by plasma etching method or wet etching method using the photoresist patterns 30 and 30' as an etching mask to form a plurality of second metal patterns 31.

Finally, as shown in FIGS. 2(*g*) and 3(*e*), the photoresist patterns 30 and 30' and the photoresist 28 filled in the groove 24 are removed by photoresist removing solution, for example, acetone, thereby forming the fine inductor having the 3-dimensional coil structure and rendering inside of the coil hollow.

As mentioned above, since the inductor has the 3-dimensional coil structure wherein the inside of the coil is hollow and it is buried in the semiconductor substrate, and magnetic flux flows in a direction parallel to the semiconductor substrate along an empty space of the coil, loss of magnetic flux is reduced to form the inductor having relatively high inductance.

Further, since contact areas of coil line adjacent to the semiconductor substrate are small, it is possible to reduce parasitic capacitance and areas of inductor. When executing double metal wiring process for the inductor in semiconductor process, since there are formed no via holes, it is possible to reduce resistance values of the coil itself and since a lower structure of the coil is buried in the groove structure, it is possible to reduce deformation of the coil due to physical force.

Since the fine inductor is formed of the micro coil having the 3-dimensional and longitudinal coil structure formed by using semiconductor fine process technology, it is integrable in the communication integrated circuit and can be applicable for micro relays and switching components using longitudinally wound coil in the field of Micro Electro Mechanical System.

Although the invention has been described with reference to particular embodiments, the description is only an example of the invention's application and should not be taken as a limitation. Various adaptation and combinations of features of the embodiments disclosed are within the scope of the invention as defined by the following claims.

What is claimed is:

1. A fine inductor having a 3-dimensional coil structures comprising:

an insulating layer on a substrate having a groove;

a plurality of first conductive patterns wherein each of the first conductive patterns is formed in the groove of the insulation layer by a photo-masking process and a metal deposition process, each of the first conductive patterns covers a bottom surface and both walls of the groove, both ends of the respective first conductive patterns are extended over an upper surface of both sides of the groove, and each of the first conductive patterns is disposed at a predetermined space between adjacent first conductive patterns; and a plurality of second conductive patterns wherein each of the second conductive patterns is formed on the insulation layer by the photo-masking process and the metal deposition process after the first conductive patterns are formed in the groove of the insulation layer, one end of the respective second conductive patterns are connected to one end of the first conductive patterns extended over an upper surface and the other end of the respective second conductive patterns are connected to the other end of the respective adjacent first conductive patterns extended over the upper surface, thereby forming a coil structure together with the first conductive patterns.

2. A fine inductor according to claim 1, further comprising a pair of connecting pads which are connected to both ends of the coil.

3. A fine inductor having a 3-dimensional coil structure, comprising:

a substrate having a groove formed therein;

a plurality of first conductive patterns, wherein each of the first conductive patterns is formed in the groove of the substrate by a photo-masking process and a metal deposition process, each of the first conductive patterns covers a bottom surface and both walls of the groove, both ends of the respective first conductive patterns are extended over an upper surface of both sides of the groove, and each of the first conductive patterns is disposed at a predetermined space between adjacent first conductive patterns; and a plurality of second conductive patterns, wherein each of the second conductive patterns is formed on the substrate by the photo-masking process and the metal deposition process after the first conductive patterns are formed in the groove of the substrate, one end of the respective second conductive patterns are connected to one end of the first conductive patterns extended over an upper surface and the other end of the respective second conductive patterns are connected to the other end of the respective adjacent first conductive patterns extended over the upper surface, thereby forming a coil having a 3-dimensional structure.

4. A fine inductor according to claim 3, further comprising a pair of connecting pads which are connected to both ends of the coil having said 3-dimensional structure.

5. A fine inductor according to claim 4, wherein said first and second conductive patterns correspond to metal patterns forming the coil having said 3-dimensional structure.

* * * * *